US011484914B2

(12) United States Patent
Mandler et al.

(10) Patent No.: US 11,484,914 B2
(45) Date of Patent: Nov. 1, 2022

(54) SORTING INSTALLATION FOR PARCELS AND METHOD FOR SORTING PARCELS

(71) Applicant: SIEMENS AKTIENGESELLSCHAFT, Munich (DE)

(72) Inventors: Eberhard Mandler, Reichenau (DE); Philipp Pfeifer, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 17/260,037

(22) PCT Filed: May 17, 2019

(86) PCT No.: PCT/EP2019/062821
§ 371 (c)(1),
(2) Date: Jan. 13, 2021

(87) PCT Pub. No.: WO2020/011431
PCT Pub. Date: Jan. 16, 2020

(65) Prior Publication Data

US 2021/0268548 A1 Sep. 2, 2021

(30) Foreign Application Priority Data

Jul. 13, 2018 (EP) ..... 18183338

(51) Int. Cl.
*B07C 3/08* (2006.01)

(52) U.S. Cl.
CPC ..... *B07C 3/08* (2013.01)

(58) Field of Classification Search
CPC ..... B07C 3/08
See application file for complete search history.

(56) References Cited

U.S. PATENT DOCUMENTS 9,845,194 B2 * 12/2017 Chirol ..... G06Q 10/087
10,758,944 B2 9/2020 Miette et al.
(Continued)

FOREIGN PATENT DOCUMENTS

CN 103559600 A 2/2014
CN 206631968 U 11/2017
(Continued)

*Primary Examiner* — Gene O Crawford
*Assistant Examiner* — Lester III Rushin
(74) *Attorney, Agent, or Firm* — Laurence A. Greenberg; Werner H. Stemer; Ralph E. Locher

(57) ABSTRACT

A sorting installation for parcels uses an efficient sorting process based on properties of the parcels. The sorting installation has at least one parcel inlet and a parcel outlet that discharges sorted parcels for external transportation. A conveying mechanism transports the parcels to be sorted from the parcel inlet into a sorting area of the sorting installation. The sorting area has a sorting mechanism that sorts the multiplicity of parcels according to at least one item of parcel-related sorting information and removes them from the conveying mechanism at a transfer station. The sorting area also includes primary buffer stores, which receive and temporarily store parcels sorted by the sorting mechanism according to the parcel-related sorting information. The primary buffer stores are set up to be moved to the at least one transfer station depending on the at least one item of parcel-related sorting information.

12 Claims, 1 Drawing Sheet

(56) References Cited

U.S. PATENT DOCUMENTS

| | | | | |
|---|---|---|---|---|
| 10,974,283 | B2 * | 4/2021 | Bombaugh | B07C 3/008 |
| 11,338,331 | B2 * | 5/2022 | Becher | B07C 3/08 |
| 2013/0096713 | A1 | 4/2013 | Takizawa et al. | |

FOREIGN PATENT DOCUMENTS

| | | | | |
|---|---|---|---|---|
| EP | 3371077 | B1 * | 5/2022 | B65G 1/1371 |
| WO | 2017021596 | A1 | 2/2017 | |
| WO | 2018115608 | A1 | 6/2018 | |
| WO | WO-2020264255 | A2 * | 12/2020 | B65G 1/0478 |

* cited by examiner

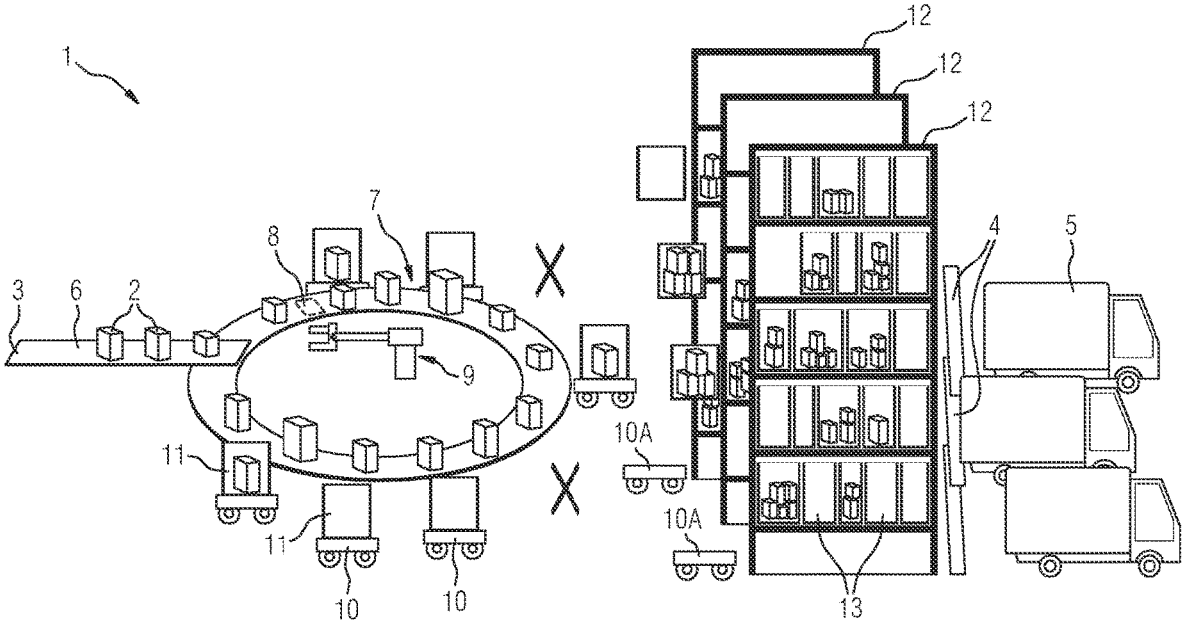
1
3
6
2
8
7
9
11
11
10
10
10A
10A
12
12
12
4
5
13

SORTING INSTALLATION FOR PARCELS AND METHOD FOR SORTING PARCELS

BACKGROUND OF THE INVENTION

Field of the Invention

The invention relates to a sorting installation for parcels and to a method for sorting parcels in a sorting installation.

A parcel within the context of this application is to be understood as any sort of object able to be sent, which can be transported by a logistics company. The term is thus not just to be understood as being restricted to objects in box form.

The parcel sorting process in the parcel center (sorting installation) has previously been a single-stage, linear process, which separates the parcels, identifies them, determines their destination in the parcel center according to the sorting depth and transports each parcel to this previously predefined location and stores it there. Thus geometrical prerequisites for the parcel center are fixed, which in practice restricts the number of possible sorting destinations.

In this process the typical solution appears as sorting being done in one level, since parcels are above all transported away by trucks that are waiting at parcel outlets (gates). The gate width therefore has a lower minimum of approx. 3 m. The number of sorting destinations thus depends directly on the spatial extent of the sorting installation. Since the speed of parcel movement is restricted in order to avoid damage to the parcels, the cycle frequency is in a direct relationship to the size of the sorting installation. The average capacity of the sorting installation and thus the effectiveness also depend directly on this.

In today's installations the space at the parcel storage location at the parcel outlets is restricted, since it is directly included in the depth of the sorting installation. Therefore the trucks are used nowadays as temporary stores, i.e. the trucks are partly loaded several times in succession. Sorting inside the truck according to specific characteristics of the parcel (weight, size, service quality, etc.) is therefore not easily possible, since it would further delay the loading process. The large number of storage locations (in many centers it is twice the number of the physical sorting destinations) and thereby of parcel outlets does not allow a cost-effective automatic loading.

SUMMARY OF THE INVENTION

The object is to design the sorting process in sorting installations more efficiently and to make possible a better sorting of the parcels according to characteristics (weight, size, service quality, etc.).

According to the invention a sorting installation for parcels is provided, comprising:

at least one parcel inlet, which is set up to receive a multiplicity of parcels to be sorted into the sorting installation, at least one parcel outlet, which is set up to discharge sorted parcels from the sorting installation to external transport means, a conveying mechanism, which is set up to transport the parcels to be sorted from the parcel inlet into a sorting area of the sorting installation, and wherein the sorting area comprises:

a sorting mechanism, which is set up to sort the multiplicity of parcels according to at least one item of parcel-related sorting information and to remove them from the sorting mechanism at at least one transfer station of the sorting installation.

primary buffer stores, which are set up to receive and to temporarily store in each case at least one parcel sorted by the sorting mechanism according to the at least one item of parcel-related information, wherein the primary buffer stores are set up to be moved to the at least one transfer station depending on the at least one item of sorting information.

In the proposed new sorting installation for parcels a two-stage process is used, in which the movement path of the individual parcels no longer depends on the quantity of the parcel outlets and many parcels are transported to a dynamically assigned position, at which they are stored in a primary buffer store. In the second stage the sorted parcels are transported via the primary buffer stores to their ultimate loading position in each case at the individual parcel outlets, wherein these loading positions are used dynamically for different destinations. When for example parcels are to be sorted for two different delivery regions, then first of all the primary buffer stores can be loaded until such time as it is established that enough parcels for an external transport means (e.g. a truck) are temporarily stored in the store for one delivery region. Then all primary buffer stores that have stored parcels for this delivery region can be moved together to the same parcel outlet and the external transport means can be rapidly loaded. As soon as enough parcels are then temporarily stored for an external transport means (e.g. a truck) for another delivery region, the same parcel outlet can be moved to collectively by buffer stores with parcels temporarily stored for this delivery region. The number of parcel outlets can thus be greatly reduced and the time that the trucks remain at the parcel outlets can likewise be drastically shortened. The number of sorting destinations (e.g. a series of zip codes) can be decoupled from the number of parcel outlets.

The first part of the previous sorting process (separation, identification, defining the destination in the sorting installation according to the sorting depth) can be retained. Sorting destinations (for example for associated delivery regions of parcels) that receive a high volume of parcels are preferably given a fixed assignment at the start of the sorting area. Thereafter the dynamic placement of the primary buffer stores along the conveying mechanism can take place for the parcels. The conveying mechanism can extend into the sorting area.

The primary buffer stores can be assigned dynamically to the sorting destinations according to the at least one item of parcel-related information of the identified parcels. Parcel to be sorted and primary buffer store meet each other for the receipt of the parcel when the parcel is removed from the conveying mechanism by the sorting mechanism. Each primary buffer store can receive one of more parcels.

The parcel-related sorting information can for example comprise:

a destination address or a part thereof (zip code, street, street section etc.), a weight of the parcel, the dimensions of a parcel, a delivery type (e.g. standard delivery, express delivery, same-day delivery etc.).

The parcel-related information can already be communicated when the respective parcel is delivered to the sorting installation and/or just recognized in the sorting installation by sensors.

The length of the sorting path in the sorting area is given by the number of fixed sorting destinations (e.g. a number of zip codes) and the length of the flexible area, which is given by the speed of provision, the storage volume and the number of (mobile) primary buffer stores. The primary buffer stores must be able to store temporarily at least one (preferably a number of) complete parcel volumes (e.g. one truck load).

The sorting installation can always be informed, via a control unit for example, about the load state and the number of available primary buffer stores (directory). Empty primary buffer stores and completely full primary buffer stores can be handled separately in order to increase efficiency.

It is also possible to define the loading sequence of the individual primary buffer stores according to a parcel-related item of sorting information, i.e. to load large and/or heavy parcels into a buffer store first and then to load smaller and/or lighter parcels into it. A control unit and the sorting mechanism of the sorting installation can be set up accordingly.

In the primary buffer stores loads for the external transport means for one sorting destination can be assembled from these parcels (various items of parcel-related sorting information can be included for this), either when the volume is reached or when a time limit is reached. Then the primary buffer stores can be sequenced and transported further. Here they are either loaded (primary buffer store equals transport store, reloaded (primary buffer store does not equal transport store) or loaded directly from the primary buffer store without further wrapping. Since the parcels now arrive at the parcel outlet in a qualified manner, an automatic loading is a cost-effective facility. Thus at the post outlets there can be an automatic loading station, for example comprising a robot arm or a freight crane. The number of parcel outlets needed is dramatically reduced (by a ratio of 10:1), since the same parcel outlet can be used for different sorting destinations in turn.

The sorting mechanism can comprise a cross-belt sorter, a tilt-tray sorter and/or a sliding shoe sorter.

The at least one transfer station can be integrated into the sorting mechanism or can be downstream from said mechanism. A transfer station can for example comprise predefined positions on and next to the conveying mechanism, at which a parcel and a primary buffer store can meet for transfer of the parcel. A transfer mechanism (comprising a flap, a pusher, a robot arm etc.) can then convey the parcel into the primary buffer store, when it is established that both are in place.

The automated placing of the primary buffer store along the transport mechanism (conveyor path) in the sorting area can be achieved with the aid of automated IT. Various control strategies are conceivable.

The inventive solution allows the number of possible sorting destinations to be designed largely independently of the extent of the building. With the same size of sorting installation considerably more sorting destinations (>20) are able to be realized. At the same time the transport path for parcels is greatly reduced (to around 30%). Thus the energy requirement and investment costs fall.

It is moreover possible to realize different parcel volumes for different sorting destinations. Moreover weight and dimensions of the parcels can be used as a sorting criterion.

The storage size of the primary buffer stores used per sorting destination is flexible and only dependent on the real volume and the different parcel-related sorting information used as the criterion. Primary buffer stores of different sizes can also be used.

The option of greatly increasing the number of sorting destinations enables a later sorting stage to be saved.

This leads to shorter overall process times and thus to possible later delivery times of the parcels (makes same-day delivery easier for example).

The use of buffer stores within the building also provides the option of better controlling the climate of the buffer store (higher sorting quality). For example it is possible to cool parcels for specific sorting destinations in the primary buffer stores.

In a preferred form of embodiment the primary buffer stores comprise driverless transport vehicles controlled by a control unit of the sorting installation and/or a GridSorter©. The driverless transport vehicles can comprise modular buffer store media, in which the parcels can be temporarily stored and which e.g. are discharged to a parcel outlet or to another buffer store or can be removed from the driverless transport vehicle. The driverless transport vehicle can then be provided in an automated manner at another point in the sorting installation with a new empty modular buffer store medium. A GridSorter© can be integrated into the sorting mechanism and be located upstream of the driverless transport vehicle for example and thus serve as a temporary store. At the same time a GridSorter© allows a number of parcels for the same sorting destination to be loaded into a driverless transport vehicle, whereby the time that it spends in the sorting area is reduced. This increases the efficiency of the sorting installation. A GridSorter© can also be combined with a transfer station, so that parcels are initially transferred in the sorting mechanism to the GridSorter© and are temporarily stored in order then to be received later by another primary or secondary buffer store.

In a preferred form of embodiment the sorting installation comprises secondary buffer stores, wherein the secondary buffer stores are set up to receive sorted parcels from the primary buffer stores and hold them until they are collectively further transported to one or more parcel outlets. The secondary buffer stores on the one hand serve to increase the number of sorting destinations, since a smaller number of primary buffer stores is needed in order to serve a specific number of sorting destinations. The secondary buffer stores can have larger part volumes (secondary storage media) than the primary buffer stores. A load for a sorting destination can be collected by the primary buffer stores in the secondary buffer stores for example until said load is complete or until a predetermined time has elapsed. Thereafter the parcels can be transported collectively to a sorting destination.

In a further preferred form of embodiment the secondary buffer stores comprise a container freight station and/or a high-shelf warehouse. These solutions are relatively favorable and volume-efficient. At the same time the number of primary buffer stores, which tend to be more expensive, (e.g. driverless transport vehicles) can be restricted.

In a further preferred form of embodiment the primary buffer stores are set up to transport at least a part of the sorted parcels collectively to at least one parcel outlet. This form of embodiment can also be used when secondary buffer stores are available, for example for especially urgent parcels (express delivery, same-day delivery, etc.).

It is preferred that primary buffer stores are set up to fetch at least a part of the sorted parcels collectively at the secondary buffer stores and transport them to a parcel outlet. In this form of embodiment the primary buffer stores also serve as transport stores for a collective transport of a load of parcels to a parcel outlet from the secondary buffer stores. The secondary buffer store media can be identical to the primary buffer store media, meaning that a uniform modular system can be used within the sorting installation for example.

In one form of embodiment the secondary buffer stores are set up to transport at least a part of the sorted parcels collectively to at least one parcel outlet. It is also possible for the secondary buffer store media (freight container, parcel collection vessel, etc.) to be transported by a separate transport system to the respective parcel outlet. This can be a freight crane system and/or a further conveying mechanism (e.g. a transport belt) for example.

It is preferred for the sorting installation to comprise at least one sensor, which is set up to detect at least one item of parcel-related sorting information of each of the multiplicity of parcels. To recognize the parcel-related sorting information one or more sensors, such as cameras, scanners, scales etc. can be arranged in the sorting installation, in particular in the sorting area. A part or all of the parcel-related sorting information can however also already be known when the parcel is delivered to the sorting installation and be communicated to the sorting installation, in particular by automatic data transfer from a transport means making the delivery.

In one form of embodiment the sorting installation is set up to have at least a part of the buffered parcels transported collectively to at least one of the parcel outlets according to at least one item of parcel-related sorting information.

The inventive object is also achieved by a method for sorting of parcels in a sorting installation, comprising:

at least one parcel inlet, which receives a multiplicity of parcels to be sorted into the sorting installation, a conveying mechanism, which transports the parcels to be sorted from the parcel inlet into a sorting area of the sorting installation, wherein the sorting area comprises:

a sorting mechanism, which sorts the multiplicity of parcels according to at least one item of parcel-related sorting information and removes them from the conveying mechanism at at least one transfer station of the sorting installation, primary buffer stores, which each receive and temporarily store at least one parcel sorted according to the at least one item of sorting information, wherein the primary buffer stores are moved to the at least one transfer station depending on the at least one item of sorting information, wherein the sorted parcels are discharged from the sorting installation to external transport means via the at least one parcel outlet.

The advantages corresponding to those of the inventive sorting installation are produced. In particular the inventive method allows the number of possible sorting destinations to be designed largely independently of the extent of the building of the sorting installation. With the same size of sorting installation considerably more sorting destinations (>20) are able to be realized. At the same time the transport path for parcels is greatly reduced (to approx. 30%). Thus the energy requirement and the investment costs fall. Moreover it is possible to realize different volumes of parcels for different sorting destinations. Moreover weight and dimensions of the parcels can be used as a sorting criterion in the method. Even if it was already possible beforehand to determine this parcel-related sorting information, because of individual arrival of the parcels at the parcel outlet, it was scarcely possible to make any use of this information without markedly delaying the loading. The inventive method allows the large and heavy parcels to be delivered first to the respective parcel outlet however.

The size of the primary buffer store used per sorting destination is flexible and only dependent on the real volume and the different parcel-related information used as criterion, determined by sensors for example. Primary buffer stores of different sizes can also be used. The option of greatly increasing the number of sorting destinations enables a later sorting stage to be saved. This leads to shorter overall processing times and thus possibly to later delivery times for the parcels.

In one form of embodiment of the method the primary buffer stores transport at least a part of the sorted parcels collectively to at least one parcel outlet. This form of embodiment can also be used when secondary buffer stores are available, for example for especially urgent parcels (express delivery, same-day delivery, etc.).

In a further form of embodiment of the method the sorting installation comprises secondary buffer stores, which receive sorted parcels from the primary buffer stores and hold them until they are collectively further transported to one or more parcel outlets, wherein the secondary buffer stores transport at least a part of the sorted parcels collectively to at least one parcel outlet, and/or wherein the primary buffer stores fetch at least a part of the sorted parcels collected at the secondary buffer stores and transport them to at least one parcel outlet. In this form of embodiment the primary buffer stores can also serve as transport stores for a collective transport of a load of parcels from the secondary buffer stores to a parcel outlet. The secondary buffer stores can be identical to the primary buffer stores, meaning that a uniform modular system can be used within the sorting installation for example. It is also possible for the secondary buffer store media (freight container, parcel collection vessel, etc.) to be transported by a separate transport system to the respective parcel outlet. This can be a freight crane system and/or a transport belt for example.

It is preferred for the sorting installation to transport a part of the buffered parcels in each case according to at least one item of sorting information to at least one parcel outlet. The parcels can be transported in this case in this case via primary buffer stores and optionally via secondary buffer stores.

All features and forms of embodiment disclosed with regard to the sorting installation are also claimed with regard to the method and vice versa.

The characteristics, features and advantages of this invention described above as well as the manner in which these are achieved will become clearer and easier to understand in conjunction with the description of the exemplary embodiments given below, which are explained in greater detail with reference to the drawings.

BRIEF DESCRIPTION OF THE DRAWING

The sole FIGURE shows a schematic view of an inventive sorting system.

DETAILED DESCRIPTION OF THE INVENTION

Shown in the FIGURE is an inventive sorting installation 1 for parcels 2. The sorting installation 1 comprises a parcel inlet 3, which is set up to receive a multiplicity of parcels 2 to be sorted into the sorting installation 1. The sorting installation 1 comprises at least one parcel outlet 4 (here three parcel outlets), which is set up to discharge sorted parcels 2 from the sorting installation 1 to external transport means 5 (shown here in a non-restrictive way as a truck).

The sorting installation 1 moreover comprises a conveying mechanism 6, which is set up to transport the sorted parcels 2 from the parcel inlet 3 into a sorting area 7. The conveying mechanism 6 here also comprises an annular conveying mechanism in the sorting area 7.

The sorting area 7 comprises at least one sensor 8, which is set up to detect at least one item of parcel-related sorting information of each of the multiplicity of parcels 2. As an alternative or in addition one or more items of parcel-related sorting information can be known beforehand and already be communicated when the parcel 2 is delivered to the sorting installation 1. The sensor or sensors 8 can also be arranged at other positions of the sorting installation 1.

The parcel-related sorting information to be determined can for example comprise the following information:

a destination address or a part thereof (zip code, street, street section etc.), a weight of the parcel 2, the dimensions of a parcel 2, a delivery type (e.g. standard delivery, express delivery, same-day delivery etc.).

To this end one or more sensors 8, such as cameras, scanners, scales etc. can be arranged in the sorting area 7. The sensor or the sensors 8 can, as indicated here, be integrated into the conveying mechanism 6 and/or can be arranged next to it/above it.

The sorting area 7 moreover comprises a sorting mechanism 9 (shown here by way of example as a robot arm), which is set up to sort the multiplicity of parcels 2 according to the at least one item of parcel-related sorting information and to remove them from the conveying mechanism 6 at at least one transfer station and supply them to primary buffer stores 10, 10*a*. The sorting mechanism 9 can comprise a cross-belt sorter, a tilt-tray sorter and/or a sliding shoe sorter. The sorting mechanism can however also be integrated partly or entirely into the conveying mechanism 6.

The primary buffer stores 10, 10*a* are set up to receive at least one parcel 2 sorted by the sorting mechanism 9 according to the item of at least item of parcel-related information and to buffer it.

The sorting installation 1 is set up to have a part of the buffered parcels 2 in each case transported collectively to one of the parcel outlets 4 according to at least one item of parcel-related sorting information.

The primary buffer stores 10, 10A here comprise a driverless transport vehicle controlled by a control unit (not explicitly shown) of the sorting installation 1. The driverless transport vehicles comprise modular buffer storage media 11 in which the parcels 2 can be buffered and which e.g. can be discharged to a parcel outlet 2 or to another buffer store or can be removed from the driverless transport vehicle. The driverless transport vehicle can then be provided at another point in the sorting installation with a new empty modular buffer storage medium 11 in an automated manner.

A GridSorter© can be integrated into the sorting mechanism 0 or the conveying mechanism 6, i.e. for example be located upstream of the driverless transport vehicles and thus serve as a buffer. At the same time a GridSorter© equally allows a number of parcels 2 for the same sorting destination to be loaded into a driverless transport vehicle, whereby their idle time is reduced. This increases the efficiency of the sorting installation 1.

The sorting installation 1 here also comprises secondary buffer stores 12. The secondary buffer stores 12 are set up to receive sorted parcels 2 from the primary buffer stores 10, 10A and to hold them until they are collectively further transported to one or more parcel outlets 4. Here it is indicated that two primary buffers stores 10A have each unloaded their modular buffer storage medium 11 into a secondary buffer store 12. The modular buffer storage media 11 can be identical to modular buffer storage media 13 of the secondary buffer stores 12 (as indicated here) and or can differ from said media.

The secondary buffer stores 12 can comprise a container freight station and/or a high-shelf warehouse. Shown in FIG. 1 are secondary buffer stores 12 in the form of three high-shelf warehouses, wherein the use of the same buffer storage media is advantageous in this case. If a container freight station is used, the secondary buffer storage media 13 can be freight containers and thus differ from the buffer storage media 11 of the primary buffer stores 10, 10A.

Although the invention has been illustrated and described in greater detail by preferred exemplary embodiments, the invention is not restricted by the disclosed examples and other variations can be derived herefrom by the person skilled in the art, without departing from the scope of protection of the invention.

LIST OF REFERENCE CHARACTERS

1 Sorting installation
2 Parcel
3 Parcel inlet
4 Parcel outlet
5 Transport means
6 Conveying mechanism
7 Sorting area
8 Sensor
9 Sorting mechanism
10 Primary buffer store
10A Primary buffer store
11 Buffer storage medium
12 Secondary buffer store
13 Buffer storage medium

The invention claimed is:

1. A sorting installation for parcels, the sorting installation comprising:

at least one parcel inlet configured to receive a multiplicity of parcels to be sorted;

at least one parcel outlet configured to discharge sorted parcels from the sorting installation to external transport means;

a conveying mechanism configured to transport the parcels to be sorted from the parcel inlet into a sorting area of the sorting installation;

the sorting area having:

a sorting mechanism configured to sort the multiplicity of parcels according to at least one item of parcel-related sorting information and to remove the parcels from said conveying mechanism at at least one transfer station of the sorting installation; and primary buffer stores each configured to receive at least one parcel sorted by said sorting mechanism according to the at least one item of parcel-related sorting information and to buffer the at least one parcel;

said primary buffer stores being configured for movement to said at least one transfer station in accordance with the at least one item of parcel-related sorting information; and secondary buffer stores configured to receive sorted parcels from said primary buffer stores and to hold the sorted parcels until the sorted parcels are collectively further transported to one or more parcel outlets; and said primary buffer stores being configured to fetch at least some of the sorted parcels collectively from said secondary buffer stores and to collectively transport the sorted parcels to at least one of the parcel outlets.

2. The sorting installation according to claim 1, wherein said primary buffer stores comprise driverless transport vehicles and/or a GridSorter controlled by a control unit of the sorting installation.

3. The sorting installation according to claim 1, wherein said secondary buffer stores comprise a container freight station and/or a high-shelf warehouse.

4. The sorting installation according to claim 1, wherein said primary buffer stores are configured to transport at least a part of the sorted parcels collectively to at least one parcel outlet.

5. The sorting installation according to claim 4, wherein said primary buffer stores are configured to fetch at least a part of the sorted parcels collectively from secondary buffer stores and to transport the sorted parcels to at least one parcel outlet.

6. The sorting installation according to claim 1, wherein said secondary buffer stores are set up to transport at least a part of the sorted parcels collectively to at least one parcel outlet.

7. The sorting installation according to claim 1, comprising at least one sensor disposed to detect at least one item of parcel-related sorting information of each of the multiplicity of parcels.

8. The sorting installation according to claim 1, configured to have at least a part of the buffered parcels transported collectively to at least one of the parcel outlets in each case according to at least one item of parcel-related sorting information.

9. A method for sorting parcels in a sorting installation, comprising:

receiving at a parcel inlet of the sorting installation a multiplicity of parcels to be sorted;

transporting the parcels to be sorted on a conveying mechanism from the parcel inlet into a sorting area of the sorting installation;

sorting the multiplicity of parcels with a sorting mechanism of the sorting area in accordance with at least one item of parcel-related sorting information and removing the parcels from the conveying mechanism at at least one transfer station of the sorting installation;

receiving and buffering respective parcels that have been sorted by the sorting mechanism in accordance with the at least one item of sorting information in primary buffer stores;

moving the primary buffer stores to the at least one transfer station depending on the at least one item of sorting information; and discharging the sorted parcels via at least one parcel outlet from the sorting installation to external transport means.

10. The method according to claim 9, which comprises using the primary buffer stores to transport at least a part of the sorted parcels collectively to at least one parcel outlet.

11. The method according to claim 9, which further comprises:

receiving sorted parcels from the primary buffer stores in secondary buffer stores and holding the sorted parcels before the sorted parcels are collectively further transported to one or more parcel outlets;

wherein the secondary buffer stores transport at least a part of the sorted parcels collectively to at least one parcel outlet;

and/or wherein the primary buffer stores fetch at least a part of the sorted parcels collected at the second buffer stores and transport the sorted parcels to at least one parcel outlet.

12. The method according to claim 9, which comprises transporting a part of the buffered parcels collectively to at least one of the parcel outlets of the sorting installation in each case according to at least one item of parcel-related sorting information.

* * * * *